US006293811B1

(12) United States Patent
Frantz

(10) Patent No.: US 6,293,811 B1
(45) Date of Patent: Sep. 25, 2001

(54) CONNECTOR AND HEATING ELEMENT ASSEMBLY

(75) Inventor: Robert Houston Frantz, Newville, PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/168,243

(22) Filed: Oct. 8, 1998

Related U.S. Application Data

(60) Provisional application No. 60/061,628, filed on Oct. 9, 1997.

(51) Int. Cl.[7] ..... H01R 4/66
(52) U.S. Cl. ..... 439/101; 439/95; 439/928
(58) Field of Search ..... 439/101, 92, 95, 439/100, 610, 318, 108, 103, 513, 928

(56) References Cited

U.S. PATENT DOCUMENTS

| | | | | |
|---|---|---|---|---|
| 2,234,132 | * | 3/1941 | Simpson | 439/928 |
| 3,174,028 | * | 3/1965 | Ammerman | 219/455 |
| 4,109,992 | * | 8/1978 | Hughes et al. | 339/147 R |
| 4,117,310 | * | 9/1978 | Clark | 219/451 |
| 4,176,903 | * | 12/1979 | Cairo et al. | 339/147 R |
| 4,711,506 | * | 12/1987 | Tanaka | 439/108 |
| 4,732,568 | * | 3/1988 | Hall | 439/676 |
| 4,740,173 | * | 4/1988 | Justiano et al. | 439/351 |
| 4,906,208 | * | 3/1990 | Nakamura et al. | 439/607 |
| 5,092,790 | * | 3/1992 | Justiano et al. | 439/535 |
| 5,207,603 | * | 5/1993 | Peloza | 439/884 |
| 5,221,212 | * | 6/1993 | Davis | 439/108 |
| 5,304,069 | * | 4/1994 | Brunker et al. | 439/108 |
| 5,306,164 | * | 4/1994 | Hollander et al. | 439/103 |
| 5,356,313 | * | 10/1994 | Niea et al. | 439/607 |
| 5,645,435 | * | 7/1997 | Cimino et al. | 439/92 |
| 5,711,686 | * | 1/1998 | O'Sullivan et al. | 439/108 |
| 5,829,991 | * | 11/1998 | Murphy et al. | 439/610 |

* cited by examiner

*Primary Examiner*—Paula Bradley
*Assistant Examiner*—Katrina Davis
(74) *Attorney, Agent, or Firm*—Michael Aronoff

(57) ABSTRACT

An assembly of a connection end of a heating element and a connector matable therewith includes a heating element having side-by-side-rod sections, a ground strap mounted to the rod elements and a connector mountable to a frame of an electronic device. The connector includes at least two power terminals and at least one ground terminal. The power terminals are receptacles and the rod sections of the heating element include an integral male lead dimensioned to be directly connected to respective receptacle terminals. The ground strap is disposed over the rod sections and is adapted to mate with the ground terminal in the connector.

4 Claims, 3 Drawing Sheets

CONNECTOR AND HEATING ELEMENT ASSEMBLY

This claims priority to prov. app. No. 60/061,628, filed Oct. 9, 1997.

FIELD OF THE INVENTION

The invention is directed to electrical connectors and more particularly to heating elements and connectors matable therewith.

BACKGROUND OF THE INVENTION

Surface burners used for electric ranges, grills, broilers, and the like typically have an interconnection system that allows the burner to be removed from the range or other equipment for purposes of cleaning, repair, and replacement. The connectors may be used for standard burners having rod-like heating elements, hereinafter referred to as "rod elements", or may be used for an interchangeable cooking module having rod elements at one end of the module for inserting into the range. In the current accepted industry standard, a tab-like terminal is terminated to the end of a cold rod secured within the end of the rod element, the terminal being insertable into a tab-receiving connector mounted to the frame of the electrical device. Alternatively, the end of the cold rod may be formed into a loop that is insertable into the connector mounted to the stove frame. For purposes of illustrating the invention, the invention will be described with reference to an electric range. It is to be understood that the connector system may be used with heating elements for other electric devices, such as bake and broil elements, dishwashers, clothes dryers, furnaces and the like.

The prior art connector includes a metal shell disposed around a dielectric housing, the shell being connected to a metal frame of the range for purposes of grounding. The terminals or the loops at the ends of the rod elements are typically in the size range of 0.312–0.375 inches wide and from 0.070 to 0.095 inches thick. The dimensions of the shell surrounding the housing are typically on the order of 1.156 inches wide, 1.9 inches deep and about 0.78 inches tall. The opening in the shell is relatively large, thus grease or other contaminants could to get into the connector, causing damage to the terminals and possibly requiring replacement of the connector and/or burner.

It is desirable, therefore, to have a connector system that is smaller, has robust terminals, and is more cost effective to manufacture.

SUMMARY OF THE INVENTION

The present invention is directed to an assembly of a connection end of an electrical resistance heating element terminating in a pair of side-by-side rod sections and a connector matable therewith. The connector includes a dielectric housing having at least two power terminals disposed in passageways therein, and at least one ground terminal therein, adapted for establishing a ground connection with the heating element. The power terminals are receptacles and each of the ends of the heating element rod sections includes an integral male lead that extends outwardly therefrom. Each lead is dimensioned to be directly connected to a respective receptacle terminal upon insertion into the mating face of the housing. A ground strap is disposed over the heating element rod sections rearwardly of the ends and has a forwardly directed contact extending substantially parallel to the leads. The ground strap contact is adapted to be mated to the ground terminal in the housing. The receptacle terminals are dimensioned to connect directly to conductors of the rod elements, rather than to mating terminals, as in the prior art. The resulting connector has a smaller housing with smaller apertures therein than those found in the prior art thus minimizing the chances of grease or other containments from entering the connector passageways.

The receptacle terminal for use in a range, for example, is dimensioned to receive rod elements within a size range of 14–18 AWG. It is to be understood that the terminals may have other configurations and dimensions to accommodate rod elements of different sizes. The inner surfaces of the receptacle terminal furthermore, include a series of inwardly directed protrusions that assure that the terminal engages the outwardly extending conductor of the rod element at multiple locations. In one embodiment, each receptacle terminal is essentially triangular in shape thus allowing the terminal to accept a range of conductor sizes by expanding outwardly when a larger conductor is received therein.

The connector housing further includes at least one ground terminal electrically connectable to a ground sheath and dimensioned to receive a ground strap that is mounted to the rod element. The ground strap includes a first portion having apertures dimensioned to receive and engage the outer surface of respective ends of a rod element and a forwardly directed contact that extends substantially parallel to the rod element and is dimensioned to engage the ground terminal prior to the rod element engaging the power terminals.

An embodiment will now be described by way of example with reference to the accompanying drawings.

DETAILED DESCRIPTION OF AN EMBODIMENT OF THE INVENTION

Figure 1:
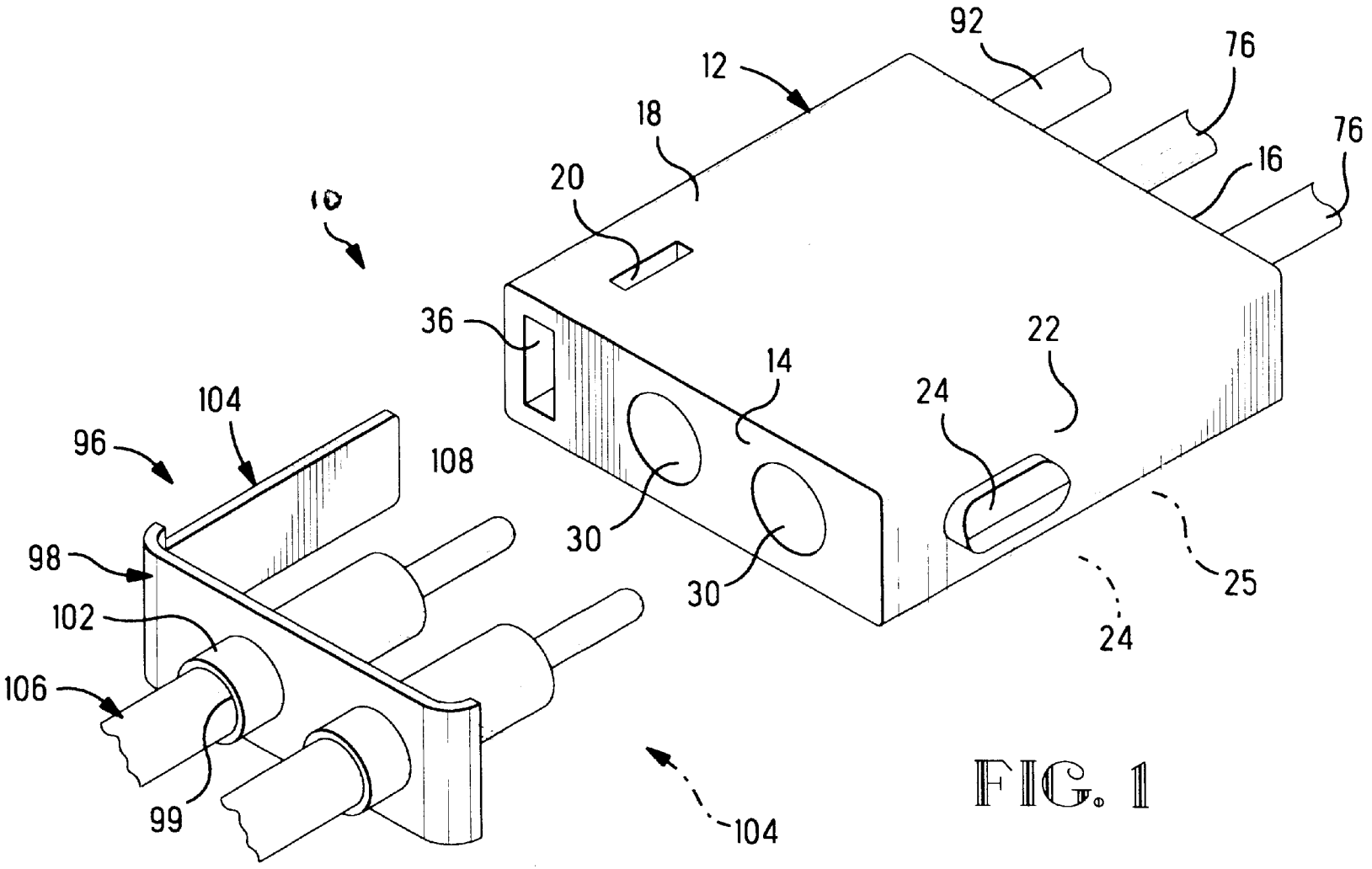
FIG. 1 is an isometric view of the connector assembly including a connector with the ground sheath removed and a ground strap mounted proximate the ends of the rod element with the conductors extending forwardly therefrom and with an additional ground contact and mating housing portion therefor shown in phantom.
Figure 2:
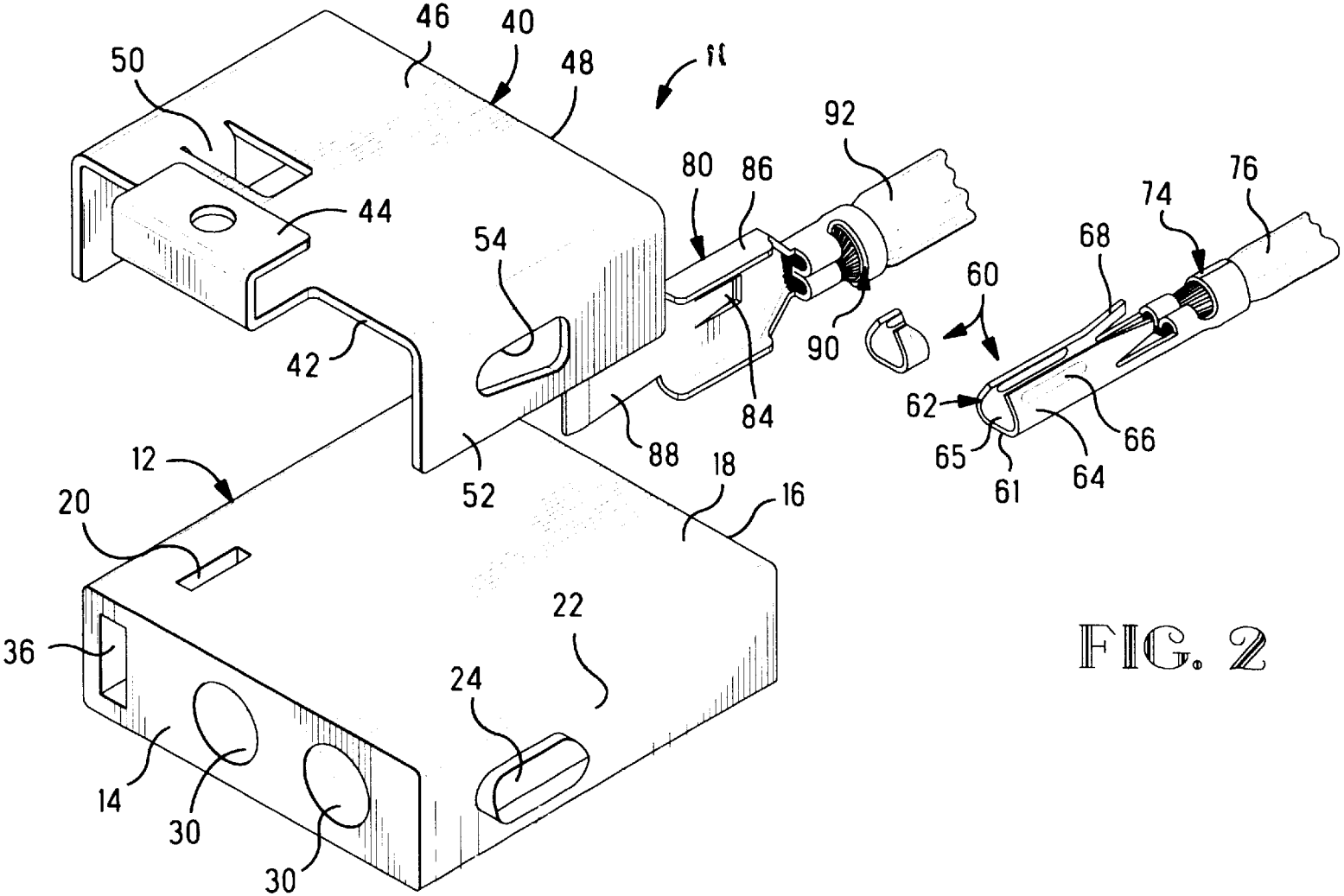
FIG. 2 is an isometric view of the connector of the present invention with the parts exploded.
Figure 3:
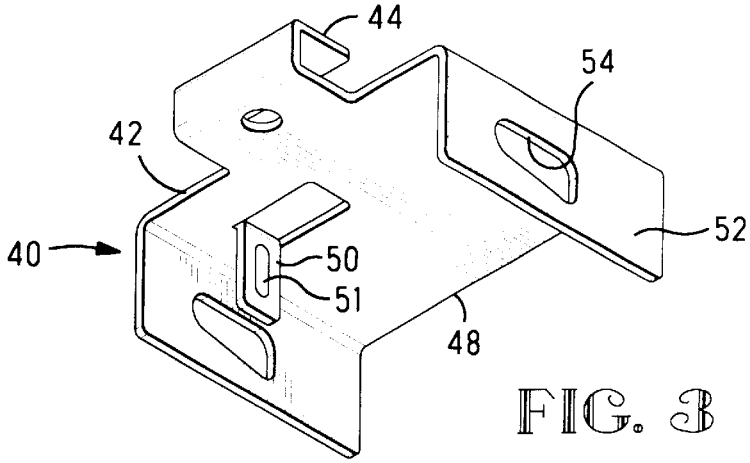
FIG. 3 is an isometric view of the underside of the ground sheath of FIG. 1.

Referring now to FIGS. 1 through 4 the connector assembly 10 includes connector 11, heating element sections 106 of a heating element (not shown) and ground strap 96. Connector 11 includes a dielectric housing 12, a ground sheath 40, a pair of power terminals 60 and at least one ground terminal 80. The connector 11 is adapted to mate with a ground strap 96 mounted to ends of rod sections 106 having integral male leads 108 extending forwardly therefrom, the ground strap 96 including at least one forwardly extending ground contact 104.

Dielectric housing 12 includes a front or mating face 14, a rear face 16, opposed major surfaces 18, opposed side walls 22 and a plurality of power terminal-receiving passageways 30 extending between the mating and rear faces 14, 16 and at least one ground terminal-receiving passageway 36 extending between the mating and rear faces 14, 16. One major surface 18 includes an aperture 20 extending into the ground terminal-receiving passageway 36 and side walls 22 include outwardly extending projections 24 adapted to cooperate with ground sheath 40 as more fully explained below. Housing 12 may be made from heat resistant phenolic resins, porcelain, or other suitable materials, as known in the art.

Figure 4:
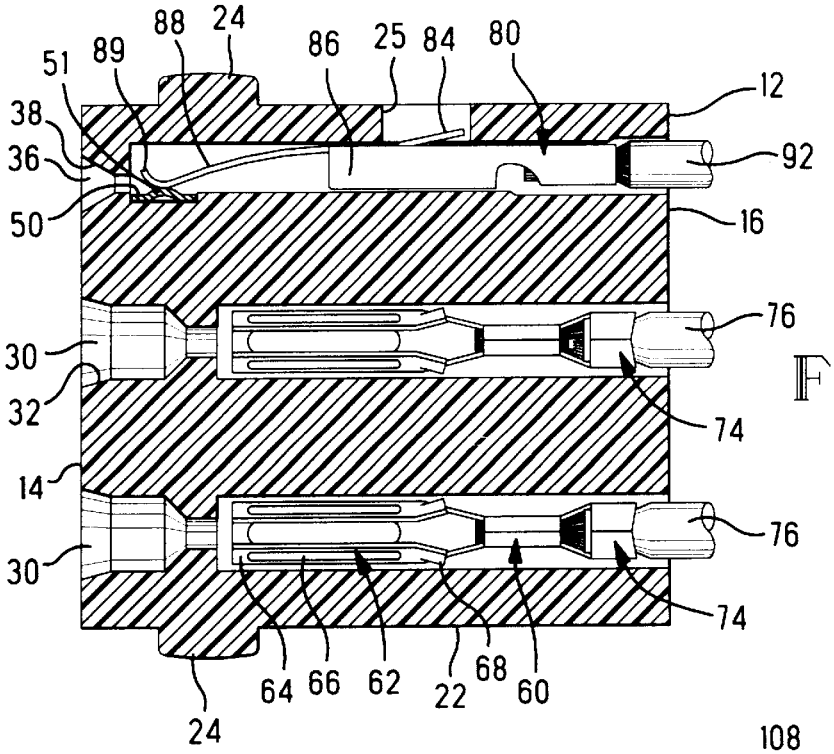
FIG. 4 is cross-sectional view of the connector of FIG. 2.

Ground sheath 40 includes a forward end 42, a rear edge 48 and side walls 52. A major surface 46 includes a downwardly directed tab 50 adapted to be received within aperture 20 of housing 12 for connecting to the ground terminal 80, as shown in FIG. 4. Downwardly directed tab 50 includes an embossment 52 for assuring electrical contact with the ground terminal 80. The forward edge 42 of sheath 40 includes an upwardly directed retention tab 44 adapted to be secured to an electric range or the like, as known in the art. Sheath side walls 52 include apertures 54 dimensioned to be received on protrusions 24 when the ground sheath 40 is secured to the housing 12. Additionally, as best seen in FIG. 4, side walls 22 further include an aperture 25 extending into the ground terminal receiving passageway 36. Ground sheath 40 may be formed of stainless steel or the like.

Figure 5:
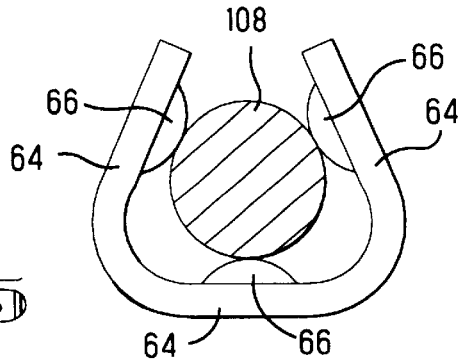
FIG. 5 is a cross sectional view of the power terminal of FIG. 1 mated to the conductor of FIG. 4.

Power terminal 60 includes a terminal body 61 having a forward mating portion 62 and a conductor terminating portion 74. The forward mating portion 62 includes two side wall portions 64 extending angularly upward from base 63, such that body 61 and side wall portions 64 define a triangular terminal receiving cavity 65. The side walls 64 and base 63 include inwardly directed protrusions 66 that are adapted to engage a mating conductor 108 at a plurality of locations, as shown in cross section in FIG. 5. The terminals 60 are dimensioned to receive conductors that are in the range of 0.09±0.003. Each side wall section 64 further includes a rearwardly directed retention tab 68 adapted to engage surfaces within the terminal-receiving cavity 30. Power terminal 60 are terminated to respective power cables 76. The terminals are made from suitable copper alloys, or the like, as known in the art.

The ground terminal 80 includes a terminal body 82 having side walls 86, a forwardly directed mating portion 88 and a cable terminating portion 90. Terminal body 82 further includes an outwardly directed retention tab 84. Terminal 80 is terminated to a ground cable 92.

FIG. 4 is a cross-sectional view of the housing 12 with two power terminals 60 and ground terminal 80 disposed therein. The terminal-receiving passageways 30 include a tapered lead-in portion 32 that is progressively reduced in size and extends inwardly to align each mating conductor 108 with one of the receptacle terminals 60. The ground terminal 80 is shown with the cantilever tab 88 extending forwardly in the terminal-receiving passageway 36 with the leading end 89 proximate the protrusion 52 of the ground sheath 40. The retention tab 84 is secured in aperture 25 of side wall 22. As can be seen in FIG. 4 the ground tab mating portion 88 extends forwardly of the mating ends of the power terminal 60 to assure that the ground connection is made prior to the power of terminals being mated.

FIG. 1 illustrates the ground strap 96 mounted to a pair of rod sections 106 that extend from a heating element (not shown) of a burner or the like. Each rod section 106 includes an integral male lead 108 extending outwardly therefrom. The ground strap 96 includes a mounting portion 98 having a plurality of apertures 99 extending therethrough for receiving the rod sections 106. An outwardly directed collar portion 102 surrounds each aperture 99, the collar portion 102 being adapted to be secured to a respective rod sections 106. Ground strap 96 further includes at least one ground contact 104 extending forwardly therefrom and essentially parallel to the ends of rod sections 106 when assembled thereto. The ground contact 104 includes a leading end 105 adapted to mate with the leading end 89 of the ground terminal 80 prior to engagement of the male leads 108 of rod sections 106 engaging respective power terminals 60.

FIG. 1 further illustrates in phantom, a second ground-receiving passageway 36 that may be added if desired on the second side of the power terminals 60 and a second ground contact 104 on ground strap 96. The ground sheath 40 would likewise be dimensioned to accommodate the enlarged housing and be further provided by an additional ground tab (not shown).

The connector 11 is more compact than the presently available connectors. The width of the connector remains the same, 1.155 inches, owing to the standardized spacing of the ends of the rod elements. The height of the connector is approximately one-half that of the prior art connector. The depth of the connector is also less than that of the prior art. The respective terminal-receiving passageways 30 and 36 are also smaller thus minimizing the area that may be exposed to grease or other contamination which may be spilled on the range. The present invention provides a smaller assembly that is more cost effective to manufacture and eliminates the use of terminals terminated to the ends of rod sections, thus reducing the cost of the burner assemblies. The dimensions of the leading ends 32, 38 of the terminal-receiving passageways 30, 36 are designed to be "user friendly" in that a burner can be readily removed and readily reengaged after cleaning. The sheath is mounted to one side of the housing, rather than surrounding the entire housing, thus further reducing the dimensions of the assembly with respect to the prior art and making the entire assembly more cost effective to manufacture.

It is thought that the connector and heating element assembly of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An assembly of a connection end of an electrical resistance heating element and a connector matable therewith, the heating element terminating in a pair of side-by-side rod sections, and wherein the connector includes a dielectric housing having at least two power terminals disposed in passageways therein, and at least one ground terminal therein, adapted for establishing a ground connection with said heating element, the power and at least one ground terminals being accessible at a mating face of the housing; the assembly being characterized in that:

said power terminals are receptacles;

each of said ends of said heating element rod sections includes an integral male lead that extends outwardly therefrom, each said lead being substantially straight and dimensioned to be directly connected to a respective said receptacle terminal upon insertion into said mating face of said housing; and a ground strap disposed over said heating element rod sections rearwardly of said ends and having a forwardly directed contact extending substantially parallel to said leads, said ground strap contact being adapted to be mated to said ground terminal in said housing.

2. The assembly of claim 1 wherein said receptacle power terminals are triangular.

3. The assembly of claim 1 wherein said connector further includes a ground sheath disposed around said housing, said sheath being in electrical engagement with said ground terminal, said sheath providing grounding for said assembly.

4. The assembly of claim 1 wherein said ground strap includes two ground contacts and said connector includes two ground terminals.

* * * * *